US007584096B2

(12) United States Patent
Makinen et al.

(10) Patent No.: US 7,584,096 B2
(45) Date of Patent: Sep. 1, 2009

(54) METHOD AND APPARATUS FOR ENCODING SPEECH

(75) Inventors: Jari Makinen, Tampere (FI); Janne Vainio, Lempäää (FI); Hannu Mikkola, Tampere (FI)

(73) Assignee: Nokia Corporation, Espoo (FI)

( * ) Notice: Subject to any disclaimer, the term of this patent is extended or adjusted under 35 U.S.C. 154(b) by 701 days.

(21) Appl. No.: 10/804,104

(22) Filed: Mar. 19, 2004

(65) Prior Publication Data

US 2005/0102136 A1 May 12, 2005

(30) Foreign Application Priority Data

Nov. 11, 2003 (GB) ..... 0326263.1

(51) Int. Cl.
*G10L 19/04* (2006.01)

(52) U.S. Cl. ..... 704/230

(58) Field of Classification Search ..... 704/230
See application file for complete search history.

(56) References Cited

U.S. PATENT DOCUMENTS 5,475,712 A * 12/1995 Sasaki ..... 375/241
5,667,420 A * 9/1997 Menow et al. ..... 446/433
5,708,754 A * 1/1998 Wynn ..... 704/219
6,272,459 B1 * 8/2001 Takahashi ..... 704/221
6,449,590 B1 * 9/2002 Gao ..... 704/219
6,453,289 B1 * 9/2002 Ertem et al. ..... 704/225
6,633,841 B1 * 10/2003 Thyssen et al. ..... 704/233
6,816,832 B2 * 11/2004 Alanara et al. ..... 704/205
6,823,303 B1 * 11/2004 Su et al. ..... 704/220
6,940,967 B2 * 9/2005 Makinen et al. ..... 379/387.01
7,020,605 B2 * 3/2006 Gao ..... 704/225

OTHER PUBLICATIONS

3GPP, Universal Mobile Telecommunications System (UMTS); Mandatory Speech Codec speech processing functions, AMR Wideband speech codec; Transcoding functions (3GPP TS 26.190 version 5.1.0 Release 5), Dec. 2001.

3GPP, Universal Mobile Telecommunications System (UMTS); AMR speech Codec; Transcoding Functions, (3GPP TW 26.090 version 5.0.0 Release 5), Jun. 2002.

3GPP, Universal Mobile Telecommunications System (UMTS); Mandatory Speech Codec speech processing functions, AMR Wideband speech codec; Voice Activity Detector (VAD); (3GPP TS 26.194 version 5.0.0 Release 5), Mar. 2001.

Roar Hagen and Erik Ekudden; IEEE, An 8 KBits/S ACELP Coder With Improved Background Noise Performance, pp. 25-28,1999.

* cited by examiner

*Primary Examiner*—Susan McFadden
(74) *Attorney, Agent, or Firm*—Squire, Sanders & Dempsey, L.L.P.

(57) ABSTRACT

A method of encoding speech in a communications system includes the steps of receiving a speech signal including voice signals and background signals, and detecting voice activity and providing an indicator when no voice activity is detected. The speech signal is encoded to generate a plurality of parameters representing the signal. When the indicator is not present, a first parametric representation of the speech signal is output, including the plurality of parameters. When the indicator is present, at least one of the plurality of parameters is modified and a second parametric representation of the speech signal, including the modified parameter is output.

19 Claims, 4 Drawing Sheets

*Listening test results*

METHOD AND APPARATUS FOR ENCODING SPEECH

FIELD OF INVENTION

The present invention relates to speech encoding in a communication system.

BACKGROUND TO THE INVENTION

Cellular communication networks are commonplace today. Cellular communication networks typically operate in accordance with a given standard or specification. For example, the standard or specification may define the communication protocols and/or parameters that shall be used for a connection. Examples of the different standards and/or specifications include, without limiting to these, GSM (Global System for Mobile communications), GSM/EDGE (Enhanced Data rates for GSM Evolution), AMPS (American Mobile Phone System), WCDMA (Wideband Code Division Multiple Access) or 3$^{rd}$ generation (3G) UMTS (Universal Mobile Telecommunications System), IMT 2000 (International Mobile Telecommunications 2000) and so on.

In a cellular communication network, voice data is typically captured as an analogue signal, digitised in an analogue to digital (A/D) converter and then encoded before transmission over the wireless air interface between a user equipment, such as a mobile station, and a base station. The purpose of the encoding is to compress the digitised signal and transmit it over the air interface with the minimum amount of data whilst maintaining an acceptable signal quality level. This is particularly important as radio channel capacity over the wireless air interface is limited in a cellular communication network. The sampling and encoding techniques used are often referred to as speech encoding techniques or speech codecs.

Often speech can be considered as bandlimited to between approximately 200 Hz and 3400 Hz. The typical sampling rate used by a A/D converter to convert an analogue speech signal into a digital signal is either 8 kHz or 16 kHz. The sampled digital signal is then encoded, usually on a frame by frame basis, resulting in a digital data stream with a bit rate that is determined by the speech codec used for encoding. The higher the bit rate, the more data is encoded, which results in a more accurate representation of the input speech frame. The encoded speech can then be decoded and passed through a digital to analogue (D/A) converter to recreate the original speech signal.

An ideal speech codec will encode the speech with as few bits as possible thereby optimising channel capacity, while producing decoded speech that sounds as close to the original speech as possible. In practice there is usually a trade-off between the bit rate of the codec and the quality of the decoded speech.

In today's cellular communication networks, speech encoding can be divided roughly into two categories: variable rate and fixed rate encoding.

In variable rate encoding, a source based rate adaptation (SBRA) algorithm is used for classification of active speech. Speech of differing classes are encoded by different speech modes, each operating at a different rate. The speech modes are usually optimised for each speech class. An example of variable rate speech encoding is the enhanced variable rate speech codec (EVRC).

In fixed rate speech encoding, voice activity detection (VAD) and discontinuous transmission (DTX) functionality is utilised, which classifies speech into active speech and silence periods. During detected silence periods, transmission is performed less frequently to save power and increase network capacity. For example, in GSM during active speech every speech frame, typically 20 ms in duration, is transmitted, whereas during silence periods, only every eighth speech frame is transmitted. Typically, active speech is encoded at a fixed bit rate and silence periods with a lower bit rate.

Multi-rate speech codecs, such as the adaptive multi-rate (AMR) codec and the adaptive multi-rate wideband (AMR-WB) codec were developed to include VAD/DTX functionality and are examples of fixed rate speech encoding. The bit rate of the speech encoding, also known as the codec mode, is based on factors such as the network capacity and radio channel conditions of the air interface.

AMR was developed by the 3$^{rd}$ Generation Partnership Project (3GPP) for GSM/EDGE and WCDMA communication networks. In addition, it has also been envisaged that AMR will be used in future packet switched networks. AMR is based on Algebraic Code Excited Linear Prediction (ACELP) coding. The AMR and AMR WB codecs consist of 8 and 9 active bit rates respectively and also include VAD/DTX functionality. The sampling rate in the AMR codec is 8 kHz. In the AMR WB codec the sampling rate is 16 kHz.

ACELP coding operates using a model of how the signal source is generated, and extracts from the signal the parameters of the model. More specifically, ACELP coding is based on a model of the human vocal system, where the throat and mouth are modelled as a linear filter and speech is generated by a periodic vibration of air exciting the filter. The speech is analysed on a frame by frame basis by the encoder and for each frame a set of parameters representing the modelled speech is generated and output by the encoder. The set of parameters may include excitation parameters and the coefficients for the filter as well as other parameters. The output from a speech encoder is often referred to as a parametric representation of the input speech signal. The set of parameters is then used by a suitably configured decoder to regenerate the input speech signal.

Details of the AMR and AMR-WB codecs can be found in the 3GPP TS 26.090 and 3GPP TS 26.190 technical specifications. Further details of the AMR-WB codec and VAD can be found in the 3GPP TS 26.194 technical specification. All the above documents are incorporated herein by reference.

Both AMR and AMR-WB codecs are multi rate codecs with independent codec modes or bit rates. In both the AMR and AMR-WB codecs, the mode selection is based on the network capacity and radio channel conditions. However, the codecs may also be operated using a variable rate scheme such as SBRA where the codec mode selection is further based on the speech class. The codec mode can then be selected independently for each analysed speech frame (at 20 ms intervals) and may be dependent on the source signal characteristics, average target bit rate and supported set of codec modes. The network in which the codec is used may also limit the performance of SBRA. For example, in GSM, the codec mode can be changed only once every 40 ms.

By using SBRA, the average bit rate may be reduced without any noticeable degradation in the decoded speech quality. The advantage of lower average bit rate is lower transmission power and hence higher overall capacity of the network.

Typical SBRA algorithms determine the speech class of the sampled speech signal based on speech characteristics. These speech classes may include low energy, transient, unvoiced and voice sequences. The subsequent speech encoding is dependent on the speech class. Therefore, the accuracy of the speech classification is important as it determines the speech encoding and associated encoding rate. In previously known systems, the speech class is determined before speech encoding begins.

However, absolute speech quality degrades as a function of bit rate in a multi-rate speech codec. This is especially true when strong environmental background noise (for example car, street, cafeteria) is present during the call. This makes the operation of source based rate adaptation challenging, because when there is no active speech present (that is the callers are not talking), the codec is only coding background noise and will probably select quite low bit rate modes in order to save system capacity. Users may hear the degradation even if it happens during non-active speech. For this reason, the AMR and AMR-WB codecs may utilise SBRA together with VAD/DTX functionality to lower the bit rate of the transmitted data during silence periods. During periods of normal speech, standard SBRA techniques are used to encode the data. During silence periods, VAD detects the silence and interrupts transmission (DTX) thereby reducing the overall bit rate of the transmission. In this case, background noise parameters are transmitted less often and then averaged in the receiving end to produce "comfort" noise, which sounds quite good.

However, not all systems have DTX functionality, and therefore they have to code background noise using the normal speech codec modes. In these systems, when the bit rate decreases to a very low rate, the speech codec starts to produce audible artefacts to the coded background noise, which are perceived as annoying at the receiving end.

A paper published in the IEEE Workshop of 1999, authored by Hagen and Ekudden proposes a solution to this problem. In an existing ACELP speech coder, waveform matching LPAS structures are employed which provide high quality for speech signals, but have performance limitations for background noise. According to the paper authored by Hagen and Ekudden, a novel adaptive gain coding technique is used in the ACELP coder in which energy matching is used in combination with the traditional waveform matching criteria to provide high quality for both speech and background noise. The solution offered in that paper however requires a more complex coding to be implemented, which is implemented both across speech and across background noise.

It is an aim of the present invention to find a simpler solution to improve background noise.

SUMMARY OF THE INVENTION

According to one aspect of the present invention there is provided a method of encoding speech in a communications system comprising the steps of: receiving a speech signal including voice signals and background signals; detecting voice activity and providing an indicator when no voice activity is detected; encoding the speech signal to generate a plurality of parameters representing the signal; and when said indicator is not present, outputting a first parametric representation of the speech signal comprising said plurality of parameters, and, when the indicator is present, modifying at least one of the parameters and outputting a second parametric representation of the speech signal including the modified parameter.

According to another aspect of the invention there is provided a communications system arranged to encode speech, the system comprising: an input adapted to receive a speech signal including voice signals and background signals; a voice activity detector arranged to detect voice activity and to provide an indicator when no voice activity is detected; an encoder adapted to encode the speech signal to generate a plurality of parameters representing the signal; modifying circuitry operable when the indicator is present to modify at least one of the parameters; and an output at which a first parametric representation of the speech signal is output when the indicator is not present, the first parametric representation comprising said plurality of parameters, and at which a second parametric representation of the speech signal is output when the indicator is present, the second parametric representation including the modified parameter.

BRIEF DESCRIPTION OF DRAWINGS

For a better understanding of the present invention reference will now be made by way of example only to the accompanying drawings, in which.

DETAILED DESCRIPTION OF EMBODIMENTS

The present invention is described herein with reference to particular examples. The invention is not, however, limited to such examples.

Figure 1:
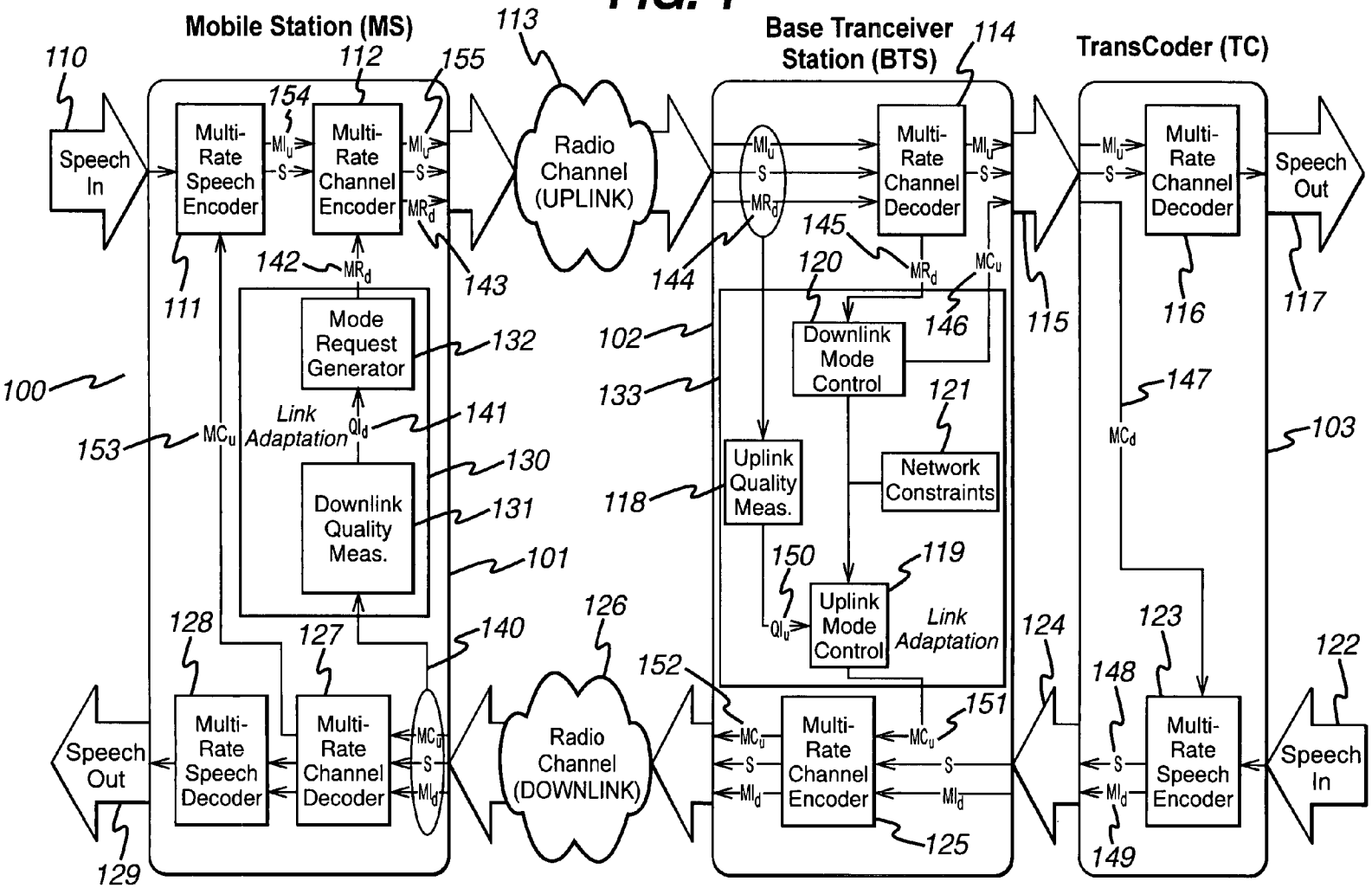
FIG. 1 illustrates a communication network in which embodiments of the present invention can be applied.

FIG. 1 illustrates a typical cellular telecommunication network 100 that supports an AMR speech codec. The network 100 comprises various network elements including a mobile station (MS) 101, a base transceiver station (BTS) 102 and a transcoder (TC) 103. The MS communicates with the BTS via the uplink radio channel 113 and the downlink radio channel 126. The BTS and TC communicate with each other via communication links 115 and 124. The BTS and TC form part of the core network. For a voice call originating from the MS, the MS receives speech signals 110 at a multi-rate speech encoder module 111.

In this example, the speech signals are digital speech signals converted from analogue speech signals by a suitably configured analogue to digital (A/D) converter (not shown). The multi-rate speech encoder module encodes the digital speech signal 110 into a speech encoded signal on a frame by frame basis, where the typical frame duration is 20 ms. The speech encoded signal is then transmitted to a multi-rate channel encoder module 112. The multi-rate channel encoder module further encodes the speech encoded signal from the multi-rate speech encoder module. The purpose of the multi-rate channel encoder module is to provide coding for error detection and/or error correction purposes. The encoded signal from the multi-rate channel encoder is then transmitted across the uplink radio channel 113 to the BTS. The encoded signal is received at a multi-rate channel decoder module 114, which performs channel decoding on the received signal. The channel decoded signal is then transmitted across communication link 115 to the TC 103. In the TC 103, the channel decoded signal is passed into a multi-rate speech decoder module 116, which decodes the input signal and outputs a digital speech signal 117 corresponding to the input digital speech signal 110.

A similar sequence of steps to that of a voice call originating from a MS to a TC occurs when a voice call originates from the core network side, such as from the TC via the BTS to the MS. When the voice calls starts from the TC, the speech signal 122 is directed towards a multi-rate speech encoder module 123, which encodes the digital speech signal 122. The speech encoded signal is transmitted from the TC to the BTS via communication link 124. At the BTS, it is received at a multi-rate channel encoder module 125. The multi-rate channel encoder module 125 further encodes the speech encoded signal from the multi-rate speech encoder module 123 for error detection and/or error correction purposes. The encoded signal from the multi-rate channel encoder module is transmitted across the downlink radio channel 126 to the MS. At the MS, the received signal is fed into a multi-rate channel decoder module 127 and then into a multi-rate speech decoder module 128, which perform channel decoding and speech decoding respectively. The output signal from the multi-rate speech decoder is a digital speech signal 129 corresponding to the input digital speech signal 122.

Link adaptation may also take place in the MS and BTS. Link adaptation selects the AMR multi-rate speech codec mode according to transmission channel conditions. If the transmission channel conditions are poor, the number of bits used for speech encoding can be decreased (lower bit rate) and the number of bits used for channel encoding can be increased to try and protect the transmitted information. However, if the transmission channel conditions are good, the number of bits used for channel encoding can be decreased and the number of bits used for speech encoding increased to give a better speech quality.

The MS may comprise a link adaptation module 130, which takes data 140 from the downlink radio channel to determine a preferred downlink codec mode for encoding the speech on the downlink channel. The data 140 is fed into a downlink quality measurement module 131 of the link adaptation module 130, which calculates a quality indicator message for the downlink channel, $QI_d$. $QI_d$ is transmitted from the downlink quality measurement module 131 to a mode request generator module 132 via connection 141. Based on $QI_d$, the mode request generator module 132 calculates a preferred codec mode for the downlink channel 126. The preferred codec mode is transmitted in the form of a codec mode request message for the downlink channel $MR_d$ to the multi-rate channel encoder 112 module via connection 142. The multi-rate channel encoder 112 module transmits $MR_d$ through the uplink radio channel to the BTS.

In the BTS, $MR_d$ may be transmitted via the multi-rate channel decoder module 114 to a link adaptation module 133. Within the link adaptation module in the BTS, the codec mode request message for the downlink channel $MR_d$ is translated into a codec mode request message for the downlink channel $MC_d$. This function may occur in the downlink mode control module 120 of the link adaptation module 133. The downlink mode control module transmits $MC_d$ via connection 146 to communications link 115 for transmission to the TC.

In the TC, $MC_d$ is transmitted to the multi-rate speech encoder module 123 via connection 147. The multi-rate speech encoder module 123 can then encode the incoming speech 122 with the codec mode defined by $MC_d$. The encoded speech, encoded with the adapted codec mode defined by $MC_d$, is transmitted to the BTS via connection 148 and onto the MS as described above. Furthermore, a codec mode indicator message for the downlink radio channel $MI_d$ is transmitted via connection 149 from the multi-rate speech encoder module 123 to the BTS and onto the MS, where it is used in the decoding of the speech in the multi-rate speech decoder 127 at the MS.

A similar sequence of steps to link adaptation for the downlink radio channel may also be utilised for link adaptation of the uplink radio channel. The link adaptation module 133 in the BTS may comprise an uplink quality measurement module 118, which receives data from the uplink radio channel and determines a quality indicator message, $QI_u$, for the uplink radio channel. $QI_u$ is transmitted from the uplink quality measurement module 118 to the uplink mode control module 119 via connection 150. The uplink mode control module 119 receives $QI_u$ together with network constraints from the network constraints module 121 and determines a preferred codec mode for the uplink encoding. The preferred codec mode is transmitted from the uplink control module 119 in the form of a codec mode command message for the uplink radio channel $MC_u$ to the multi-rate channel encoder module 125 via connection 151. The multi-rate channel encoder module 125 transmits $MC_u$ together with the encoded speech signal over the downlink radio channel to the MS.

In the MS, $MC_u$ is transmitted to the multi-rate channel decoder module 127 and then to the multi-rate speech encoder 111 via connection 153, where it is used to determine a codec mode for encoding the input speech signal 110. As with the speech encoding for the downlink radio channel, the multi-rate speech coder module for the uplink radio channel generates a codec mode indicator message for the uplink radio channel $MI_u$. $MI_u$ is transmitted from the multi-rate speech encoder control module 111 to the multi-rate channel encoder module 112 via connection 154, which in turn transmits $MI_u$ via the uplink radio channel to the BTS and then to the TC. $MI_u$ is used at the TC in the multi-rate speech decoder module 116 to decode the received encoded speech with a codec mode determined by $MI_u$.

Figure 2:
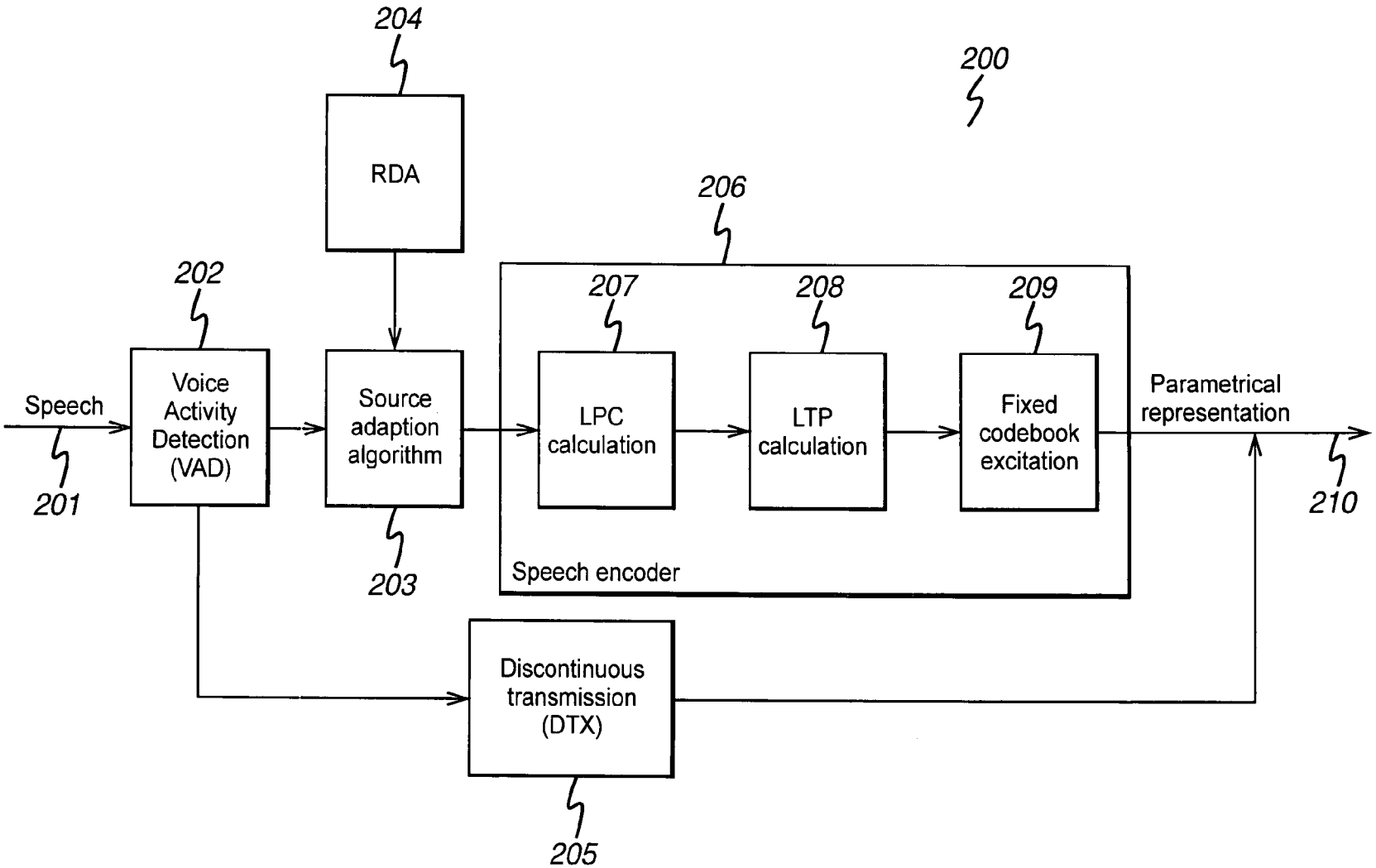
FIG. 2 (Prior Art)
FIG. 2 illustrates a block diagram of a prior art arrangement.

FIG. 2 illustrates a block diagram of the multi-rate speech encoder module 111 and 123 of FIG. 1 in the prior art. The multi-rate speech encoder module 200 may operate according to an AMR-WB codec and comprise a voice activity detection (VAD) module 202, which is connected to both a source based rate adaptation (SBRA) algorithm module 203 and a discontinuous transmission (DTX) module 205. The VAD module receives a digital speech signal 201 and determines whether the signal comprises active speech or silence periods. During a silence period, the DTX module is activated and transmission interrupted for the duration of the silence period. During periods of active speech, the speech signal may be transmitted to the SBRA algorithm module. The SBRA algorithm module is controlled by the RDA module 204. The RDA module defines the used average bit rate in the network and sets the target average bit rate for the SBRA algorithm module. The SBRA algorithm module receives speech signals and determines a speech class for the speech signal based on its speech characteristics. The SBRA algorithm module is connected to a speech encoder 206, which encodes the speech signal received from the SBRA algorithm module with a codec mode based on the speech class selected by the SBRA algorithm module. The speech encoder operates using Algebraic Code Excited Linear Prediction (ACELP) coding.

The codec mode selection may depend on many factors. For example, low energy speech sequences may be classified and coded with a low bit rate codec mode without noticeable degradation in speech quality. On the other hand, during transient sequences, where the signal fluctuates, the speech quality can degrade rapidly if codec modes with lower bit rates are used. Coding of voiced and unvoiced speech sequences may also be dependent on the frequency content of the sequence. For example, a low frequency speech sequence can be coded with a lower bit rate without speech quality degradation, whereas high frequency voice and noise-like, unvoiced sequences may need a higher bit rate representation.

The speech encoder 206 in FIG. 2 comprises a linear prediction coding (LPC) calculation module 207, a long term prediction (LTP) calculation module 208 and a fixed code book excitation module 209. The speech signal is processed by the LPC calculation module, LTP calculation module and fixed code book excitation module on a frame by frame basis, where each frame is typically 20 ms long. The output of the speech encoder consists of a set of parameters representing the input speech signal.

Specifically, the LPC calculation module 207 determines the LPC filter corresponding to the input speech frame by minimising the residual error of the speech frame. Once the LPC filter has been determined, it can be represented by a set of LPC filter coefficients for the filter.

The LPC filter coefficients are quantized by the LPC calculation module before transmission. The main purpose of quantization is to code the LPC filter coefficients with as few bits as possible without introducing additional spectral distortion. Typically, LPC filter coefficients, $\{a_1, \ldots, a_p\}$, are transformed into a different domain, before quantization. This is done because direct quantization of the LPC filter, specifically an infinite impulse response (IIR) filter, coefficients may cause filter instability. Even slight errors in the IIR filter coefficients can cause significant distortion throughout the spectrum of the speech signal.

The LPC calculation module coverts the LPC filter coefficients into the immitance spectral pair (ISP) domain before quantization. However, the ISP domain coefficients may be further converted into the immitance spectral frequency (ISF) domain before quantization.

The LTP calculation module 208 calculates an LTP parameter from the LPC residual. The LTP parameter is closely related to the fundamental frequency of the speech signal and is often referred to as a "pitch-lag" parameter, "pitch delay" parameter or "lag", which describes the periodicity of the speech signal in terms of speech samples. The pitch-delay parameter is calculated by using an adaptive codebook by the LTP calculation module.

A further parameter, the LTP gain is also calculated by the LTP calculation module and is closely related to the fundamental periodicity of the speech signal. The LTP gain is an important parameter used to give a natural representation of the speech. Voiced speech segments have especially strong long-term correlation. This correlation is due to the vibrations of the vocal cords, which usually have a pitch period in the range from 2 to 20 ms.

The fixed codebook excitation module 209 calculates the excitation signal, which represents the input to the LPC filter. The excitation signal is a set of parameters represented by innovation vectors with a fixed codebook combined with the LTP parameter. In a fixed codebook, algebraic code is used to populate the innovation vectors. The innovation vector contains a small number of nonzero pulses with predefined interlaced sets of potential positions. The excitation signal is sometimes referred to as index to algebraic codebook.

The output from the speech encoder 210 in FIG. 2 is an encoded speech signal represented by the parameters determined by the LPC calculation module, the LTP calculation module and the fixed code book excitation module, which include:

1. LPC parameters quantised in ISP domain describing the spectral content of the speech signal (spectral parameters);
2. LTP parameters describing the periodic structure of the speech signal (including open-loop lag);
3. ACELP excitation quantisation describing the residual signal after the linear predictors (residual vector);
4. Signal gain.

The bit rate of the codec mode used by the speech encoder may affect the parameters determined by the speech encoder. Specifically, the number of bits used to represent each parameter varies according to the bit rate used. The higher the bit rate, the more bits may be used to represent some or all of the parameters, which may result in a more accurate representation of the input speech signal.

Figure 3:
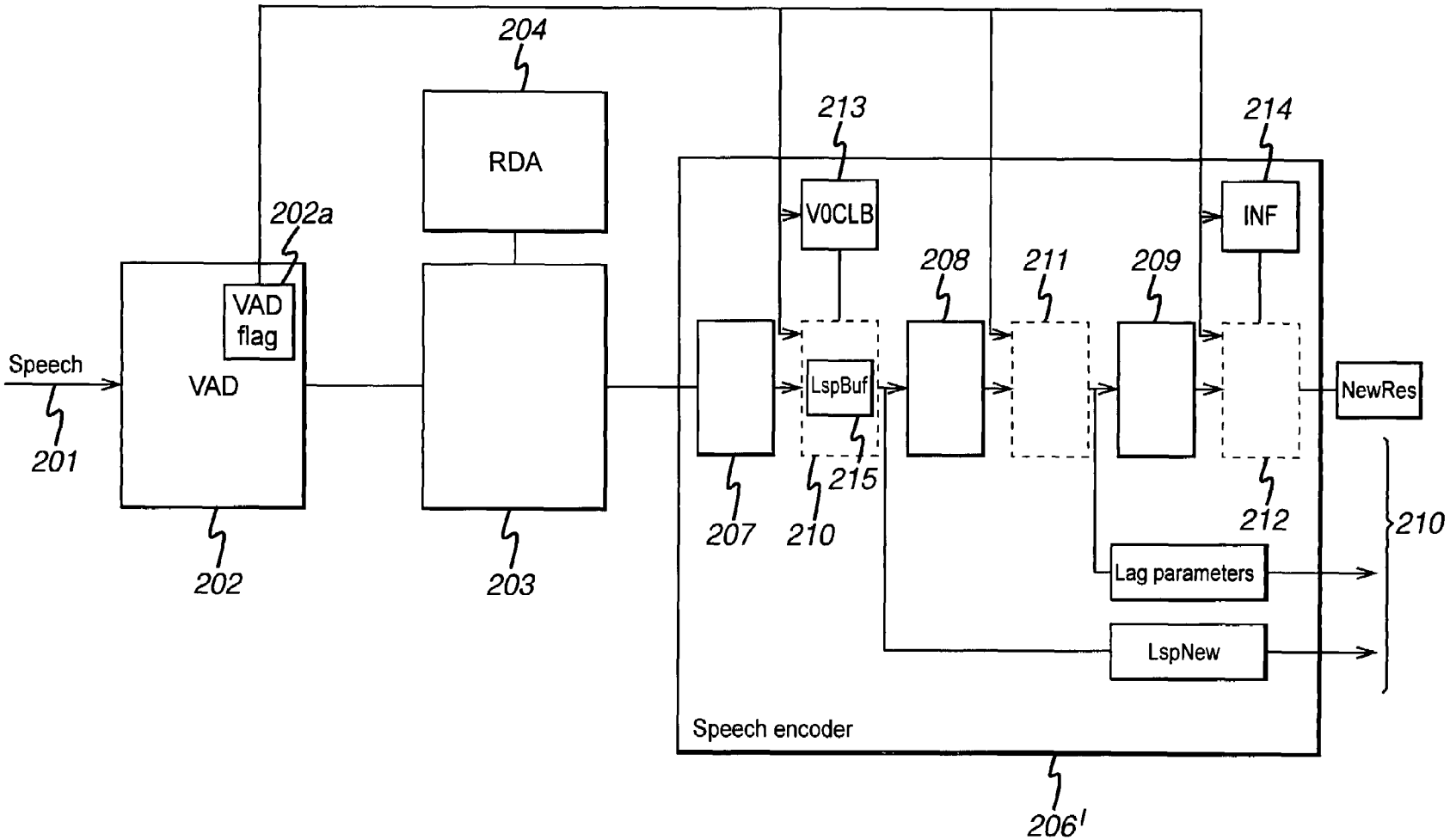
FIG. 3 illustrates a block diagram of an embodiment of the invention.

FIG. 3 illustrates an embodiment of the present invention with a modified speech encoder 206'. In addition to the LPC calculation block 207, LTP calculation block 208 and fixed code book excitation block 209 of the prior art, the modified speech encoder 206' includes a number of respective smoothing blocks which are shown in dotted lines. The smoothing blocks act to modify parameters to have the effect of smoothing background noise in the parameterised signal. Although these are illustrated as separate blocks in the speech encoder, it will be understood that they will be implemented in practice as part of the module to which they belong, by appropriate software, firmware or hardware modifications to that module. Thus, there is a first smoothing module 210 associated with the LPC calculation module 207 which acts to modify the LSP vector for the current frame to generate a modified LSP vector LspNew which is transmitted from the speech encoder as part of the parametrical representation 210 in place of the unmodified LSP vector.

In the LTP module both lag (pitch delay) and gain are produced. The first lag is calculated in open loop and then in closed loop around the open loop lag value. The open loop search for the lag gives a rough value, which is refined by the closed loop calculation. The LTP gain is related to the LTP lag (pitch) value. The gain and lag parameters are denoted generally as lag parameters in FIG. 3.

A second smoothing module 211 is associated with the LTP calculation module 208 for the purpose of modifying the open-loop lag value to generate a modified gain parameter for transmission as part of the parametrical representation. A third smoothing module 212 is associated with the fixed code book excitation module 209 for the purpose of generating a modified residual vector NewRes for transmission as part of the parametrical representation 210.

The Vad module 202 which detects voice activity includes a flag 202*a* which indicates whether or not there is voice activity. If the Vad flag is set to zero, this indicates that there is no voice activity and this causes the smoothing modules 210, 211 and 212 to become active. With the Vad flag set to one, i.e. when speech activity is detected, the smoothing modules 210, 211 and 212 do not operate, and the parametrical representation 210 is transmitted with the original parameters from the modules 207, 208 and 209 without smoothing or modification.

As illustrated in FIG. 3, the first smoothing module 210 is associated with a counter 213 which is named VadOfCountLspBuff in the following description. Similarly, the third smoothing module 212 is associated with a counter 214 which is labelled LspNoiseFact in the following description.

A description of the operation of each of the smoothing modules 210, 211 and 212 is given below.

Spectral Parameters Modification (LSP—Module 210)

VadOffCountLspBuf is the counter 213, which is set to −1, when VAD flag is set to zero. Otherwise the counter is updated as follows, based on a count of incoming frames.

$$VadOffCountLspBuf = \begin{cases} VadOffCountLspBuf < 5 & VadOffCountLspBuf{+}{+} \\ VadOffCountLspBuf \geq 5 & VadOffCountLspBuf = 5 \end{cases}$$

If VAD flag is set to zero and VadOffCountLspBuf counter is greater than zero, the following modification is done for LSP vector LSP of the current frame.

LspTemp=average(LspBuf(1) . . . LspBuf(VadOffCountLspBuf))

$$LspNew = \frac{Lsp}{VadOffCountLspBuf + 1} + \frac{LspTemp * VadOffCountLspBuf}{VadOffCountLspBuf + 1}$$

LspBuf is a buffer 215 including LSP vectors of last 5 frames. LspBuf is updated only when VAD flag is set to zero. LspBuf(1) is the LPC vector of last frame, LspBuf (2) is the LPC vector of second last frame, etc. LspTemp is the average of last frames depending on the count, VadOffCountLspBuf. LspNew is the average of current and past frames also depending on VadOffCountLspBuf and represents the smoothed vector which is transmitted as part of the parametrical representation 210.

Open-Loop LTP Lag Modification (Module 211)

If VAD flag is set to zero, the open-loop LTP lag parameter is randomised. Randomised open-loop LTP lag can get values from 20 to 120 (samples in time domain).

LP Residual Modification (Res—Module 212)

Res(0) is the residual vector of the current frame. Modified residual vector of the current frame, NewRes(0), is calculated as follows:

New*Res*(0)=*C((1−Coef)Res*(0)+Coef**Res*Max(0)*Rand*Res*)

where RandRes is random vector including values between {−1 . . . 1}. ResMax(0) is the maximum absolute value of the current residual vector Res(0).

Coef is the noise contribution for the residual vector and it is increased in steps after VAD flag is set to zero as follows:

Coef=*lsp*NoiseFact*0.0625 where lspNoiseFact is the counter 214. The counter is set to 0, when voice activity detection flag is set to zero. Otherwise it is updated as follows, based on a count of incoming frames.

$$lspNoiseFact = \begin{cases} lspNoiseFact < 8 & lspNoiseFact{+}{+} \\ lspNoiseFact \geq 8 & lspNoiseFact = 8. \end{cases}$$

Therefore Coef value will be 0.5 after 8 frames and then noise contribution will be 50% of the LP residual. C is the scaling factor which is calculated as follows:

$$C = \sqrt{\frac{ResEnergyEst(0)}{NewResEnergy}}$$

where NewResEnergy is the energy of the modified residual vector. ResEnergyEst(0) is the residual energy estimate of the current frame and it is calculated as follows:

$$ResEnergyEst(0) = \begin{cases} 0.9 * ResEnergyEst(-1) + 0.1 * ResEnergy(0), & \text{when } VAD = 0 \\ 0.66 * ResEnergyEst(-1) + 0.33 * ResEnergy(0), & \text{when } VAD = 1 \end{cases}$$

where ResEnergyEst(−1) is the residual energy estimate of the last frame and ResEnergy(0) is the energy of residual vector Res(0) of the current frame.

Figure 4:
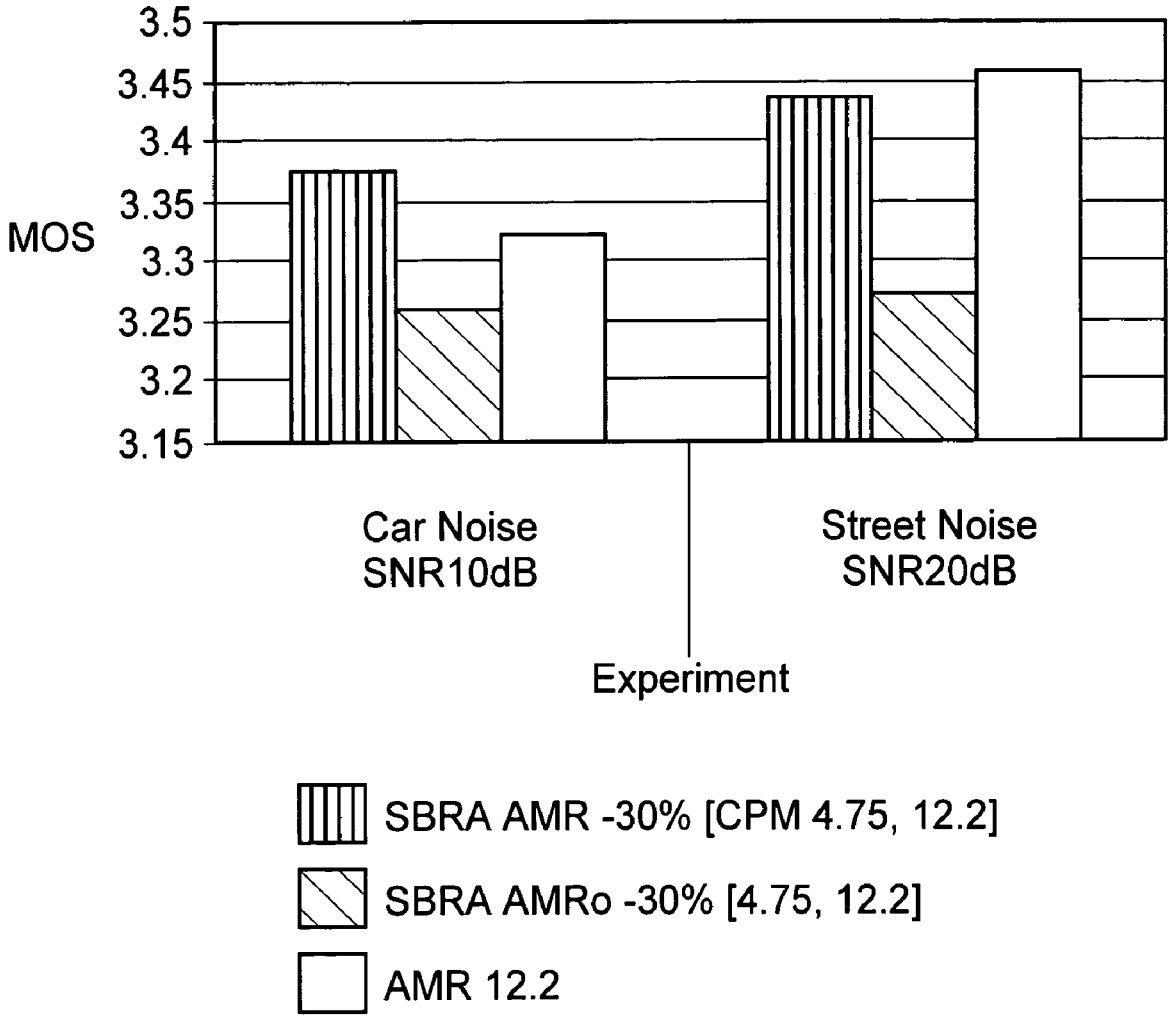
FIG. 4 illustrates test results.

A listening test was conducted with two experiments: car noise test with SNR 10 db and street noise test with SNR 20 db. As can be seen from FIG. 4, in both experiments the implementation of the smoothing function increased the overall speech quality. In fact, it was determined that by using the smoothing functions at 4.75 kbps, the speech quality could be improved to the level of AMR 12.2 kbps.

In the above-described embodiment the randomised open loop LTP lag value is used to generate the modified gain parameter output as part of the second parametric representation of the speech signal. It will be appreciated however that that gain parameter itself could be modified by randomisation or in some other way.

The invention claimed is:

1. A method, comprising:

receiving, in an encoder, a speech signal including voice signals and background signals;

detecting voice activity and providing an indicator when no voice activity is detected;

encoding the speech signal to generate a plurality of parameters representing the signal, the plurality of parameters comprising a linear prediction calculation vector of quantized linear prediction filter coefficients, a gain parameter based on open-loop lag value, and a residual vector; and when the indicator is not present, outputting a first parametric representation of the speech signal comprising the plurality of parameters, and, when the indicator is present, modifying at least one of the plurality of parameters and outputting a second parametric representation of the speech signal including the modified parameter.

2. The method according to claim 1, wherein the modifying the at least one parameter comprises modifying a value utilized in the generation of the parameter, whereby modification of that value produces a modified parameter.

3. The method according to claim 2, wherein the modifying the value comprises randomizing the value.

4. The method according to claim 1, wherein the modifying the at least one parameter comprises taking into account the energy levels associated with the parameter.

5. The method according to claim 1, wherein the speech signal is received as a sequence of samples arranged in frames.

6. The method according to claim 5, wherein the modifying the at least one parameter comprises smoothing the parameter for a current frame based on characteristics of the parameter in other frames of the speech signal.

7. The method according to claim 6, wherein said other frames include adjacent frames.

8. The method according to claim 6, wherein the modifying the at least one parameter comprises producing a count of the number of received frames up to a predetermined maximum, and using said count in the modifying step.

9. The method according to claim 1, wherein the modifying the at least one parameter comprises generating a randomized value for the parameter.

10. An apparatus, comprising:

receiving means for receiving a speech signal including voice signals and background signals;

detecting means for detecting voice activity and providing an indicator when no voice activity is detected;

encoding means for encoding the speech signal to generate a plurality of parameters representing the signal, the plurality of parameters comprising a linear prediction calculation vector of quantized linear prediction filter coefficients, a gain parameter based on open-loop lag value, and a residual vector; and outputting means for, when said indicator is not present, outputting a first parametric representation of the speech signal comprising said plurality of parameters, and, when the indicator is present, modifying at least one of the parameters and outputting a second parametric representation of the speech signal including the modified parameter.

11. A computer readable medium storing a computer program which, when executed, encodes speech by implementing a method, the method comprising:

receiving, in an encoder, a speech signal including voice signals and background signals;

detecting voice activity and providing an indicator when no voice activity is detected;

encoding the speech signal to generate a plurality of parameters representing the signal, the plurality of parameters comprising a linear prediction calculation vector of quantized linear prediction filter coefficients, a gain parameter based on open-loop lag value, and a residual vector; and when the indicator is not present, outputting a first parametric representation of the speech signal comprising the plurality of parameters, and, when the indicator is present, modifying at least one of the plurality of parameters and outputting a second parametric representation of the speech signal including the modified parameter.

12. A system, comprising:

an input unit which receives a speech signal including voice signals and background signals;

a voice activity detector which detects voice activity and to provide an indicator when no voice activity is detected;

an encoder which encodes the speech signal to generate a plurality of parameters representing the signal, the plurality of parameters comprising a linear prediction calculation vector of quantized linear prediction filter coefficients, a gain parameter based on open-loop lag value, and a residual vector;

a modifying unit which modifies, when the indicator is present at least one of the parameters; and an output unit which outputs, when the indicator is not present, a first parametric representation comprising said plurality of parameters, and to which outputs a second parametric representation of the speech signal when the indicator is present, the second parametric representation comprising the modified parameter.

13. An apparatus, comprising:

an input which receives a speech signal including voice signals and background signals;

a voice activity detector which detects voice activity and to provide an indicator when no voice activity is detected;

an encoder which encodes the speech signal to generate a plurality of parameters representing the signal, the plurality of parameters comprising of a linear prediction calculation vector of quantized linear prediction filter coefficients, a gain parameter based on open-loop lag value, and a residual vector;

modifying circuitry which modifies, when the indicator is present, at least one parameter of the plurality of parameters; and an output which outputs a first parametric representation of the speech signal when the indicator is not present, the first parametric representation comprising the plurality of parameters, and which outputs a second parametric representation of the speech signal when the indicator is present, the second parametric representation comprising the modified parameter.

14. The apparatus according to claim 13, wherein the input is receives the speech signal as a sequence of samples arranged in frames, and wherein the modifying circuitry is configured to smooth the parameter for a current frame based on characteristics of the parameter in other frames of the speech signal.

15. The apparatus according to claim 13, wherein the input is receives the speech signal as a sequence of samples arranged in frames, and wherein the modifying circuitry is produces a count of the number of received frames to a predetermined maximum, and is configured to use the count in the modifying the parameter.

16. The apparatus according to claim 13, wherein the modifying circuitry is generates a randomized value for the parameter.

17. The apparatus according to claim 13 wherein the modifying circuitry is takes into account energy levels associated with the parameter.

18. A network entity, comprising:

an input which receives a speech signal including voice signals and background signals;

a voice activity detector which detects voice activity and to provide an indicator when no voice activity is detected;

an encoder which encodes the speech signal to generate a plurality of parameters representing the signal, the plurality of parameters comprising a linear prediction calculation vector of quantized linear prediction filter coefficients, a gain parameter based on open-loop lag value, and a residual vector;

modifying circuitry which modifies, when the indicator is present, at least one parameter of the plurality of parameters; and an output which outputs a first parametric representation of the speech signal when the indicator is not present, the first parametric representation comprising the plurality of parameters, and which outputs a second parametric representation of the speech signal when the indicator is present, the second parametric representation comprising the modified parameter.

19. The network entity according to claim 18, which comprises a mobile terminal.

* * * * *